United States Patent [19]

Grant et al.

[11] Patent Number: 4,466,684

[45] Date of Patent: Aug. 21, 1984

[54] LOW INSERTION FORCE CONNECTOR

[75] Inventors: John L. Grant, Sherborn; Emanuel D. Torti, Newton; Austin S. O'Malley, Rehoboth; Thomas W. Galligan, Norton; Stephen D. DelPrete, Rehoboth, all of Mass.

[73] Assignee: Texas Instruments Incorporated, Dallas, Tex.

[21] Appl. No.: 331,728

[22] Filed: Dec. 17, 1981

[51] Int. Cl.[3] ..... H01R 9/08

[52] U.S. Cl. ..... 339/176 M; 339/220 R; 339/258 P

[58] Field of Search ..... 339/176 M, 220 R, 258 R, 339/258 P

[56] References Cited

U.S. PATENT DOCUMENTS

| | | | |
|---|---|---|---|
| 2,128,132 | 8/1938 | Frederick | 339/258 P |
| 3,120,418 | 2/1964 | Deakin | 339/258 R |
| 3,325,774 | 6/1967 | Tucker, Jr. | 339/220 R |
| 3,369,212 | 2/1968 | Coldren et al. | 339/220 R |
| 3,425,030 | 1/1969 | Hadden | 339/256 SP |
| 3,685,001 | 8/1972 | Krafthefer | 339/258 R |
| 3,711,819 | 1/1973 | Matthews | 339/220 R |
| 3,768,068 | 10/1973 | Palecek | 339/258 R |
| 3,824,557 | 7/1974 | Mallon | 339/258 R |
| 3,862,792 | 1/1975 | Jayne | 339/258 R |
| 4,002,400 | 1/1977 | Evans | 339/258 R |
| 4,232,931 | 11/1980 | Takeuchi et al. | 339/258 R |
| 4,298,242 | 11/1981 | McKee | 339/258 R |

*Primary Examiner*—John McQuade

*Assistant Examiner*—Gary F. Paumen

*Attorney, Agent, or Firm*—James P. McAndrews; John A. Haug; Melvin Sharp

[57] ABSTRACT

A low insertion force connector has metal conductors disposed in respective openings in an insulating connector body. Each conductor has a bridge portion extending in a square inside its respective body opening and has integral leaf springs extending from respective sides of the square toward a terminal entry end of the body opening. Two pairs of the springs are disposed so that the springs in each pair face each other around a common axis for receiving a terminal therebetween. Each leaf spring has an obliquely disposed surface to intercept and be moved by a terminal as the terminal is inserted and a contact surface for engaging the terminal said surfaces of one pair of springs being relatively closer to the entry end of the body opening than said surfaces of the other pair of springs, thereby requiring lesser terminal insertion forces. An integral gauge strip on each conductor is connected to one pair of the springs at the terminal entry end of the body opening and extends to define the perimeter of a gauge opening or aperture on the conductor for limiting the cross-section of a terminal which can be inserted between the leaf springs through the gauge aperture. Opposite ends of the gauge strip are preferably interconnected by dove-tail means for positively fixing the perimeter of the gauge aperture. Preferably, the other pair of springs extend in cantilever relation from the conductor so that the distal ends thereof are inside the body opening.

5 Claims, 5 Drawing Figures

LOW INSERTION FORCE CONNECTOR

BACKGROUND OF THE INVENTION

The field of this invention is that of sockets or connectors for interconnecting printed circuit boards and the like and the invention relates more particularly to low insertion force connectors adapted for use in avionic applications.

Where conventional connectors have been previously used in cooperation with plug connectors to interconnect circuit boards in avionic applications and the like to meet very high performance standards, the connectors have sometimes been provided with contacts or conductors which provide resilient, four point contact with each i.c. terminal inserted into the connector. Such four point contact has typically been achieved by the use of carefully controlled spring forces so that the connectors have been adapted to receive terminals therein with modest insertion forces to provide reasonable terminal retention forces for use under selected shock and vibration conditions. Such known avionic connectors have typically included shrouds or the like for preventing the insertion of oversize terminals into the connectors to avoid damage to the spring characteristics of the connector contacts. Frequently, however, it has been difficult to provide connector contacts with suitably low insertion forces and suitably high terminal retention forces where mating male connectors having large numbers of terminals are to be mated with the receptacles of the connectors. It has also been difficult to provide shrouds or the like for excluding oversize terminals from the connector contacts at reasonable cost.

SUMMARY OF THE INVENTION

It is an object of this invention to provide novel and improved connectors for cooperating with plug connectors or the like to interconnect p.c. boards and the like; to provide such connectors which are particularly adapted to use in avionic applications and the like where high performance standards have to be met; to provide such connectors which have very low terminal insertion force characteristics while providing suitably high terminal retention properties; to provide such connectors which are of sturdy and reliable construction; and to provide such connectors which are particularly adapted for low cost manufacture and use.

Briefly described, the novel and improved connector of this invention comprises a body of electrically insulating material having a plurality of openings extending through the body and having a plurality of electrical conductors disposed in the respective body openings. Preferably each body opening has a relatively large inlet portion at the top of the body, has an intermediate portion relatively smaller than the inlet forming a first shoulder between those portions of the opening, and has an outlet portion at the bottom of the body relatively larger than the intermediate portion of the opening to form a second shoulder between those latter two portions of the opening. Each of the conductors is blanked and formed from an electrically conductive metal spring material such as beryllium copper or phosphor bronze or the like to provide the conductor with a socket or receptacle portion and with a post portion. The conductors are disposed in the conductor body openings so that the socket portions fit into the respective inlet portions of the openings and the post parts extend through the openings to extend from the body of the connector body to be electrically connected to circuit paths on a p.c. board or the like.

In accordance with this invention, the socket portion of each conductor has an integral strip shaped to extend around the perimeter of a square to form a bridge part of the conductor which is disposed inside the inlet portion of a body opening to rest on the first body shoulder in that opening. Four integral leaf or beam springs extend up from the respective four sides of the square conductor bridge part toward the open end of the body opening. That is, two pairs of the leaf springs extend up from pairs of opposite sides of the square bridge part in spaced relation to each other around a common axis which extends into the opening from the top of the connector body. In that way, the leaf springs are each adapted to resiliently engage a terminal into the body opening along that common axis.

Each leaf spring has one surface obliquely disposed relative to the noted axis to initially intercept and be moved by a terminal extending into the body opening for establishing a selected spring force in the leaf spring. That is, the obliquely disposed spring surfaces engage a terminal entering the body opening and are cammed or moved laterally in the opening to a predetermined extent to establish selected resilient spring forces in the leaf springs. The spring leaves also have contact surfaces located immediately adjacent to the obliquely disposed spring surfaces. Those contact surfaces serve to electrically engage a terminal when the terminal has been disposed in the noted body opening.

In accordance with this invention, the contact surfaces on one pair of the leaf springs are located relatively closer to the entry end of the inlet portion of the body opening than the contact surfaces on the other pair of leaf springs. Preferably, the contact surfaces on the first pair of springs are relatively closer to the entry than the obliquely disposed surfaces of the second pair of leaf springs. In that way, terminal insertion is initially required to deflect only a single pair of the leaf springs so that a lesser insertion force is required. The obliquely disposed surfaces of the second pair of springs are engaged by the terminal to be separated by further movement of the terminal into the body opening only after separation of the first pair of springs has been completed.

In accordance with this invention, each conductor also has an integral gauge strip portion connected to one of the pairs of leaf springs adjacent to the entry portion of the body opening. The gauge strip forms the perimeter of a gauge aperture for excluding the entry of oversize terminals into the socket portions of the conductors. Preferably, the gauge strip extends to define the four sides of a square gauge aperture for limiting entry of a round terminal of selected diameter. Preferably also, the ends of the gauge strip have dove-tail means interconnected so that the strip positively limits the length of the perimeter of the gauge aperture. In that way, the connector provides low terminal insertion forces and excellent terminal retention forces, positively excludes the entry of oversize terminals into the connector contacts, provides the desired four point terminal engagement with well controlled spring forces, and is adapted to be manufactured at low cost.

DESCRIPTION OF THE DRAWINGS

Other objects, advantages and details of the novel and improved connector of this invention appear in the following detailed description of preferred embodiments of the invention, the detailed description referring to the drawings in which.

DESCRIPTION OF THE PREFERRED EMBODIMENTS

Figure 1:
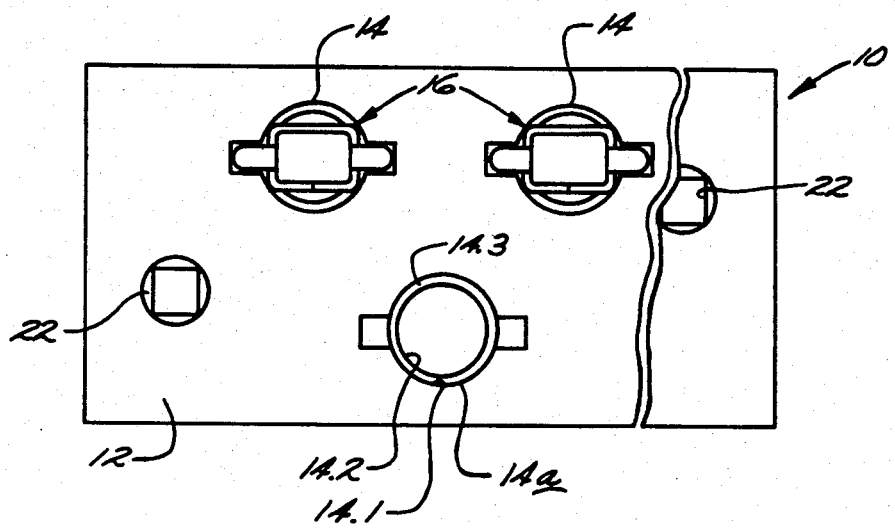
FIG. 1 is a plan view of the connector of this invention.
Figure 3:
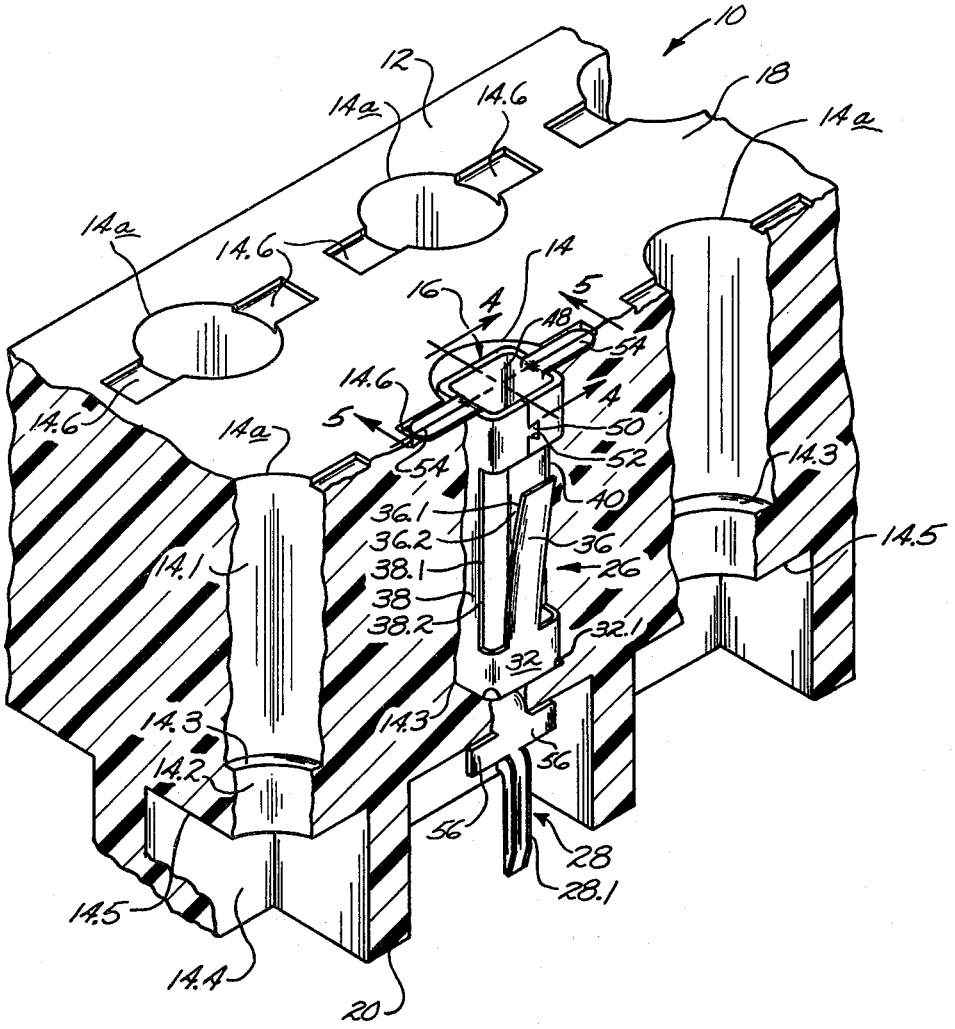
FIG. 3 is a partial perspective view of the connector of FIG. 1 to enlarged scale illustrating the mounting of the conductor of FIG. 2 in a connector body.

Referring to the drawings, 10 in FIGS. 1 and 3 indicates the novel and improved low insertion force connector of this invention which is shown to include a connector body 12 of electrical insulating material having a plurality of openings 14 extending through the body and having a plurality of electrical conductors 16 disposed in the respective body openings to make detachable electrical engagement with terminal pins from male connectors inserted into the body openings and to extend from the connector body to be electrically connected to circuit paths on a printed circuit board. For illustrating purposes, one opening 14*a* is shown in FIGS. 1 and 3 with the conductor omitted. Preferably for example, the body opening 14 has a relatively large inlet or entry portion 14.1 located at the top 18 of the body, has an intermediate portion 14.2 forming a shoulder 14.3 inside the opening, and has an outlet portion 14.4 at the bottom 20 of the body relatively larger than the intermediate portion of the opening to form a second shoulder 14.5 inside the opening as is shown particularly in FIG. 3. In the preferred embodiment, the connector body is formed of a rigid, easily moldable material such as glass-filled diallyl phthalate or polyphenylene sulfide has locating holes 22 shown in FIG. 1 in the top of the body for use as pilot holes in assembling the connector or for positioning terminal locating hardware on the connector during mounting of a mating male connector unit or the like on the connector 10 in conventional manner. Preferably, a pair of grooves 14.6 are provided on the top of the body adjacent respective opposite sides of each body opening to extend to respective opposite edges of said opening. The electrical conductors 16 are disposed in the respective body openings as is shown in FIGS. 1 and 3.

Figure 2:
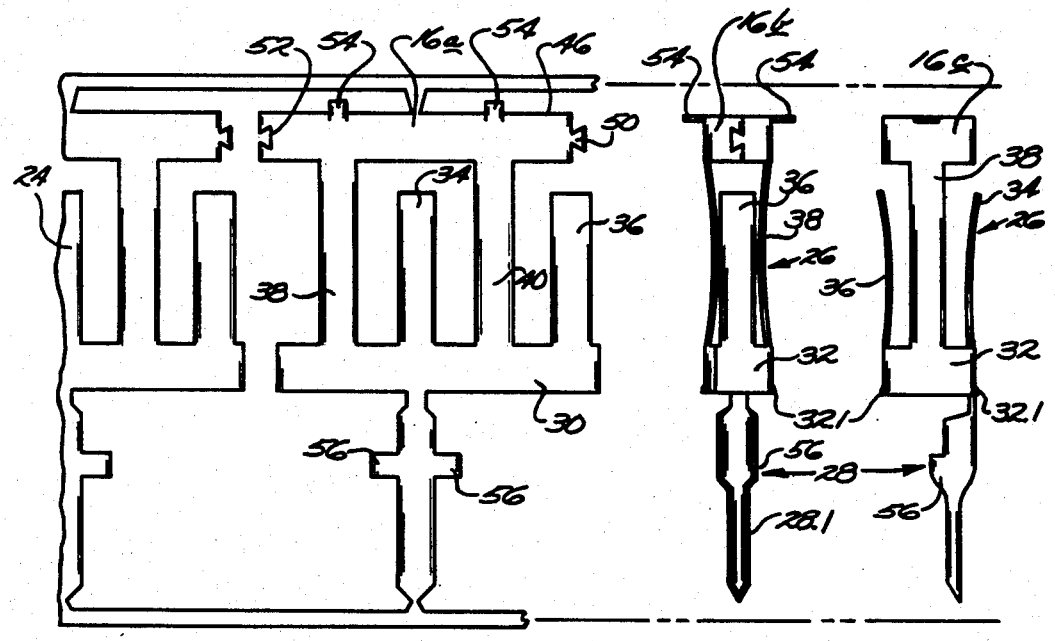
FIG. 2 is a side elevation view of the conductor contact used in the connector of FIG. 1 illustrating the conductor at various stages in its manufacture.

In accordance with this invention, the electrical conductors 16 have a configuration such that they are adapted to be blanked and formed from a metal strip material in a continuous process in any conventional manner. Preferably for example, the conductors are formed from a strip 24 of an electrically conductive metal spring material such as beryllium copper or phosphor bronze or the like by blanking as indicated as 16*a* in FIG. 2 and by folding or bending as indicated at 16*b* and 16*c* in FIG. 2 in any conventional manner. In that way, each of the conductors is provided with a socket portion 26 and with a post portion 28 as shown in FIG. 2 in an economical manner.

Figure 4:
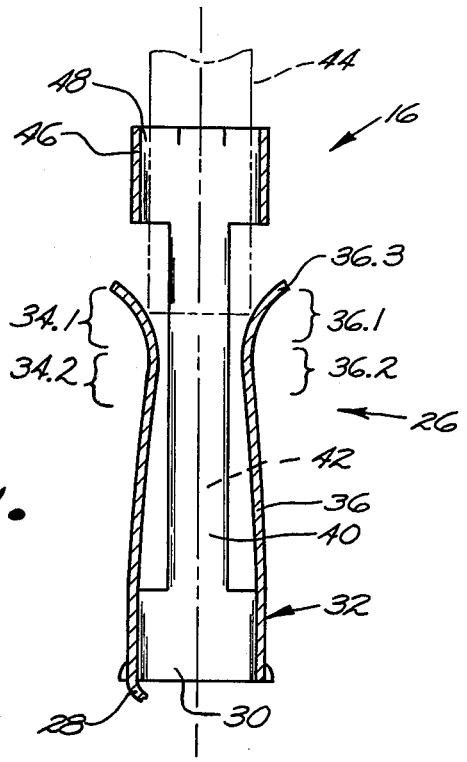
FIG. 4 is a section view of the conductor taken along line 4—4 of FIG. 3.
Figure 5:
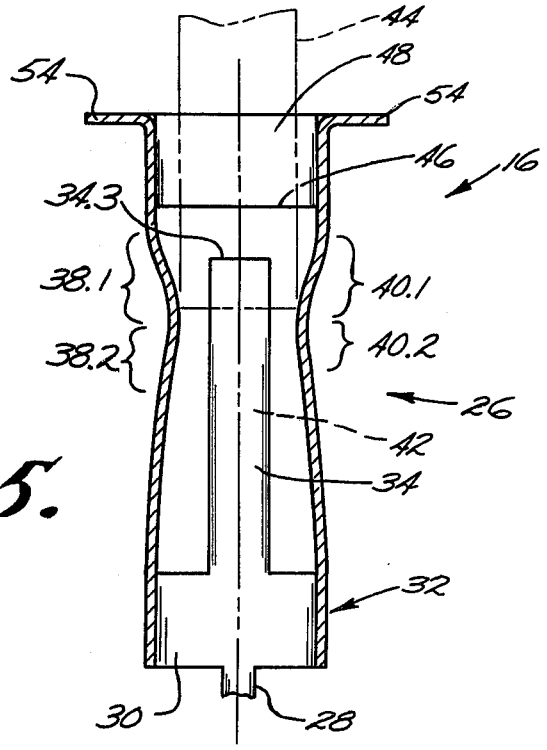
FIG. 5 is a section view of the conductor taken along line 5—5 of FIG. 3.

In accordance with this invention, each of the conductors 16 as best shown in FIGS. 3–5 has an integral strip portion 30 which is folded to define the perimeter of a square bridge part 32 of the conductor. The conductor is disposed in a connector body opening 14 (see FIG. 3) so that the bridge part of the conductor rests on the shoulder 14.3 inside the opening. In the preferred embodiment, barbs or detents 32.1 are formed on the square bridge part at the corners of the square for example for use in positioning the square bridge part in said body opening 14. Four leaf springs 34, 36, 38 and 40 are provided integral with the bridge strip 30 and extend up from respective opposite sides of the square bridge part 32 toward the top 18 of the connector body and toward the open end of the body opening 14. The pair 34, 36 of the leaf springs are disposed in spaced, facing relation to each other on opposite sides of an axis 42 which extends into the body opening. The pair 38, 40 of the leaf springs also extend in spaced, facing relation to each other on opposite sides of the same common axis. In that way, the leaf springs define a square space between the springs for receiving a terminal of a mating connector or the like between the springs and the springs are each adapted to resiliently engage such a terminal as it is axially inserted into the body opening 14 along the axis 42.

In accordance with this invention, each of the noted leaf springs is provided with a surface 34.1, 36.1, 38.1 and 40.1 which is disposed obliquely relative to the axis 42 to initially intercept a terminal (indicated by the broken lines 44 in FIGS. 4 and 5) as the terminal is being inserted into the conductor socket portion 26 and to be moved or cammed laterally away from the axis 42 to a predetermined extent by movement of the terminal to establish a selected spring force in each of the leaf springs. Each of the springs also has a contact surface 34.2, 36.2, 38.2 and 40.2 which is preferably located immediately adjacent to the obliquely disposed surface 34.1, 36.1, 38.1 or 40.1 to make electrical engagement with the terminal 44 when the terminal is fully positioned in the body opening 14.

In accordance with this invention, an integral gauge strip portion 46 of the conductor is connected to at least one of the leaf springs and is folded to define the perimeter of a gauge aperture 48 aligned with the common axis 42 of the conductor. Preferably, the ends of the strip portion 46 are connected together so that they positively fix the length of the perimeter of the gauge aperture 48. In a preferred embodiment for example, the gauge strip is integrally connected to two of the leaf springs 38, 40 adjacent to the open end of the body opening 14 at the top of the body, a dove-tail 50 is formed at one end of the gauge strip, and a dove-tail groove 52 is formed at the opposite end of the strip, the dove-tail being fitted into the groove as shown in FIGS. 2 and 3 for securing the strip ends together. In that arrangement, the other leaf springs 34, 36 are terminated below the gauge strip so that the distal ends 34.3, 36.3 of the spring are disposed inside the body opening 14. Tabs 54 provided on the gauge part of the conductor are preferably folded into the grooves 14.6 at the sides of the openings on top of the connector body for orienting the conductors in the body openings as will be understood. In that way, the gauge aperture 48 defines the maximum cross-section of the terminal 44 which can be fitted through the aperture into the socket portion 26 of each conductor. Preferably for example, the square gauge aperture is about 0.032 inches on a side and the aperture is adapted to typically receive a round terminal of 0.030 inches diameter and will exclude a terminal of greater than 0.032 inches diameter. The gauge aperture thereby avoids risk of deforming the socket portion of a conductor such as may result from the insertion of an oversize terminal therein.

In accordance with this invention, the post part 28 of the conductor is preferably folded as indicated at 28.1 (See FIG. 2) to provide ribs to increase the strength of the post part as will be understood. Tabs 56 are also formed on the post and are adapted to be folded out or apart after the conductor is inserted into a body opening so that the tabs spread out into the outlet portion 14.4 of the opening to engage the shoulder 14.5 as shown in FIG. 3, thereby to lock the conductors in the body openings. If desired, other conventional post configurations such as solder cup shape or the like are alternately provided.

In the preferred embodiment of this invention, the contact surfaces 34.2, 36.2 on one of the pairs of leaf springs are spaced relatively closer to the top of the connector body than the contact surfaces 38.2, 40.2 of the second pair of leaf springs. Preferably, the contact surfaces 34.2, 36.2 are relatively closer to the top of the body than the obliquely disposed surfaces 38.1, 40.1 of the second pair of springs as is shown in FIGS. 4 and 5. Preferably also the obliquely disposed surfaces 34.1, 36.1 of the first pair of leaf springs are spaced relatively closer to each other and to common axis 42. Conversely, the obliquely disposed surfaces 38.1, 40.1 of the second pair of springs are arranged so they intercept a terminal inserted along the axis 42 at a shallow or more oblique angle than the surfaces 34.1, 36.1.

In that arrangement, the obliquely disposed surfaces 34.1, 36.1 of one of the two pairs of leaf springs initially intercepts a terminal 44 being inserted into the conductor socket 26 as is best shown in FIG. 4. Therefore, the terminal insertion force needed to move that one pair of leaf springs apart is relatively low and the terminal is adapted to be inserted with relatively low force. As the first pair of springs 34, 36 are fully spaced apart and the terminal engages the contact surfaces 34.2, 36.2 of that pair of springs, the terminal insertion force needed to further insert the terminal into the body opening need only overcome sliding frictional forces between the terminal and the contact surfaces of that pair of springs. That is, no further force is required for spreading of the leaf springs 34, 36 and relatively small terminal insertion forces are adequate for sliding the terminal along the contact surfaces 34.2, 36.2. Then, when the terminal engages the intercepting surfaces 38.1, 40.1 of the second pair of leaf springs as shown in FIG. 5, the force inserting the terminal is again only required to be sufficient to separate a single pair of springs and to overcome the sliding friction with the contact surfaces 34.2, 36.2. Thus, only limited terminal insertion force is again required. Subsequently, when the leaf springs 38, 40 are fully separated and the terminal engages contact surfaces 38.2, 40.2, the required terminal insertion force is again relatively low and need be only sufficient to overcome sliding friction with the noted four contact surfaces. The initial spacing of the leaf springs 34, 36 is preferably less than that of the springs 38, 40 because, where they are not attached to the gauge part 46, they move more freely and require greater movement to establish a desired spring force therein. However, that smaller spacing provides additional assurance that a terminal inserted between the pair of springs will be contacted by at least that one pair of springs. Conversely, where the pair of leaf springs 38, 40 are attached to the gauge strip 46, they provide a greater column strength, require less lateral movement to establish a desired spring force, and are therefore disposed with slightly greater initial spacing than the leaf springs 34, 36 and have intercepting surfaces 38.1, 40.1 disposed at a more oblique angle to the terminal 44 being inserted into the body opening. In that arrangement, sliding of the terminal 44 along the intercepting surfaces of the second pair of leaf springs moves the leaf springs in smaller increments using the greater length of the surfaces 38.1, 40.1.

In that way, the conductors 16 are adapted to be made at low cost. However, they have a sturdy and rugged construction. They require relatively low insertion forces. Yet, they provide a desired four point contact and achieve desirably high terminal retention forces. The leaf springs of the conductors assure contact with an inserted terminal, hold the termial with desired spring forces under appropriate levels of shock, gravity and vibration forces, and the conductor gauge aperture is positively foxed so that oversize terminals which might damage the spring characteristics of the connector contacts are positively excluded. Further, the manner in which the gauge part of the conductor is joined to two of the leafs of springs assures that the conductors have substantial column strength.

It should be understood that although particular embodiments of the invention have been described by way of illustrating this invention, the invention includes all modifications and equivalents of the disclosed embodiments falling within the scope of the appended claims.

We claim:

1. A connector comprising an electrically insulating body having openings therein and having electrical conductors formed from a metal strip material disposed in the respective openings, characterized in that, each conductor has an integral bridge part disposed inside its respective opening in the body and has four integral leaf springs extending from the bridge part toward one end of the opening with pairs of the leaf springs being disposed so that the leaf springs of each pair are in facing relation to each other around a common axis which extends into the opening, the leaf springs each have a first surface disposed obliquely relative to the axis to initially intercept and be moved by a terminal being inserted into the opening along the axis from said one end of the opening to establish a selected spring force in the leaf spring and have an adjacent contact surface to electrically engage a terminal with said selected spring force when the terminal is positioned in the opening, the contact surfaces of a first pair of the leaf springs are spaced relatively closer to said one end of the body opening than the contact surfaces of the second pair of leaf springs for reducing the force required for inserting the terminal into the opening, the obliquely disposed terminal-intercepting surfaces of said second pair of leaf springs are spaced relatively further from said one end of the body opening than said contact surfaces of said first pair of leaf springs, the conductor strip material has an integral gauge part connected to distal ends of said second pair of leaf springs which are relatively longer than said first pair of leaf springs, opposite ends of the gauge part are fitted together so that the gauge part defines the perimeter of a gauge aperture of selected size for defining and limiting the cross-section of a terminal-receiving space located along said common axis between the springs of the two leaf spring pairs, and said contact and obliquely disposed terminal-intercepting surfaces of said second spring pair extend into said space for a relatively lesser distance than the corresponding surfaces of the first pair of springs for limiting the spring forces provided by the springs connected to said gauge part.

2. A connector comprising a body of electrical insulating material having a top and a bottom and having a plurality of openings extending through the body from the top to the bottom, each opening having walls defining a first relatively large inlet portion adjacent the top of the body and a second relatively smaller portion located intermediate the inlet portion of the opening and the bottom of the body, and a plurality of electrical conductors formed of a strip of an electrically conductive metal spring material disposed in the respective body openings, the conductors each having a first receptacle portion disposed in the inlet portion of a body opening to receive and resiliently engage a terminal inserted axially into the opening and having a second portion extending through the second portion of the body opening to be electrically connected in an electrical circuit, characterized in that, the receptacle portion of each conductor comprises an integral bridge part of the conductor strip material disposed in the inlet portion of its respective body opening and four integral leaf springs extending from the bridge part toward the top of the body with pairs of the leaf springs disposed so that the leaf springs in each pair are in spaced facing relation to each other around a common axis of the opening extending into the inlet portion of the body opening, the leaf springs each have a first surface disposed obliquely relative to said axis to initially intercept and be moved by a terminal being axially inserted into the inlet portion of the opening along the opening axis to establish a selected spring force in the leaf spring and have an adjacent contact surface to electrically engage a terminal with said selected spring force when the terminal is positioned in the inlet portion of the body opening, the contact surfaces of a first pair of the leaf springs are spaced relatively closer to the top of the body than the contact surfaces of the second pair of leaf springs for reducing the force required for inserting the terminal into the inlet portion of the opening, the obliquely disposed terminal-intercepting surfaces of said second pair of leaf springs are spaced relatively further from the top of said body than said contact surfaces of said first pair of leaf springs, the conductor strip material has an integral gauge part connected to distal ends of said second pair of leaf springs which are relatively longer than said first pair of leaf springs, opposite ends of the gauge part have a dove tail and a dove-tail groove respectively which are fitted together so that the gauge part defines the perimeter of a gauge aperture of selected size for defining and limiting the cross-section of a terminal-receiving space located along said common axis between the springs of the two leaf spring pairs, and said contact and obliquely disposed terminal-intercepting surfaces of said second spring pair extend into said space for a relatively lesser distance than the corresponding surfaces of the first pair of springs for limiting the spring forces provided by the springs connected to said gauge part.

3. A connector as set forth in claim 2 further characterized in that a shoulder is formed on the body within each body opening between the first and second portions of each body opening, and each conductor comprises a blanked and formed element of a metal strip material having a first integral strip portion forming the bridge part thereof as a four-sided square bridge part extending around the periphery of the inlet portion of the body opening resting on said shoulder and the respective leaf springs extend from said bridge part toward the top of the body along four sides of a square terminal-receiving space between the leaf springs.

4. A connector as set forth in claim 3 further characterized in that the bridge part has barbs thereon at a corner of said four sided square bridge part engaged in the body material for locating the bridge part in the inlet portion of the body opening.

5. A connector as set forth in claim 3 further characterized in that the walls of each of said connector body openings further define an outlet section of the opening which is relatively larger than the inlet section of the opening and which form a second body shoulder between the previously named second, intermediate section of the opening and said outlet section of the opening, the second portion of each conductor comprises a post part extending from the bottom of the body, and tabs are formed on each of said post parts and are disposed in said larger outlet section of the body opening, the tabs being folded outward into engagement with respective second body shoulders for positively locating the conductors in the body openings.

* * * * *